US005979840A

United States Patent [19]

Hollister et al.

[11] Patent Number: 5,979,840

[45] Date of Patent: Nov. 9, 1999

[54] APPARATUS FOR GRIPPING A FLUID CARRYING HOSE

[76] Inventors: Ronald S. Hollister, 14803 Rydell Rd., Apt. 202, Centerville, Va. 20121; Thomas S. Corbett, 8 Meadowbrook Rd., Brookfield, Conn. 06804

[21] Appl. No.: 09/057,939

[22] Filed: Apr. 9, 1998

Related U.S. Application Data

[60] Provisional application No. 60/036,304, Apr. 11, 1997.

[51] Int. Cl.[6] ..... A62C 13/76

[52] U.S. Cl. ..... 248/76; 248/75; 248/316.1; 239/280.5

[58] Field of Search ..... 248/75, 76, 77, 248/78, 79, 89, 59, 316.1, 316.2, 228.2, 228.6, 230.2, 230.6, 231.31, 231.71, 287.1; 169/51, 52, 25; 239/288, 280.5, 273

[56] References Cited

U.S. PATENT DOCUMENTS

| | | | |
|---|---|---|---|
| D. 360,128 | 7/1995 | Huffine | D8/396 |
| 499,933 | 6/1893 | Phillips | 280/176 |
| 661,677 | 11/1900 | Taylor | 211/22 |
| 1,197,549 | 9/1916 | Russell | 70/17 |
| 2,064,919 | 12/1936 | Kellam | 251/5 |
| 2,622,837 | 12/1952 | Goodman | 251/5 |
| 2,825,525 | 3/1958 | Kellam | 251/9 |
| 4,497,092 | 2/1985 | Hoshino | 24/514 |
| 5,351,932 | 10/1994 | von Herrmann | 251/4 |
| 5,433,405 | 7/1995 | Steever | 248/75 |

FOREIGN PATENT DOCUMENTS

| | | |
|---|---|---|
| 7-79848 | 8/1995 | Japan . |
| 7-323094 | 12/1995 | Japan . |

OTHER PUBLICATIONS

Photocopy of product brochure for "EZ–PUP" device. Applicant submits that the EZ–PUP device was described in the Fall 1996 issue of "Firefighter's News", p. 68.

*Primary Examiner*—Leslie A. Braun
*Assistant Examiner*—Gwendolyn Baxter
*Attorney, Agent, or Firm*—Raymond Nuzzo

[57] ABSTRACT

An apparatus for gripping a fluid carrying hose comprising a jaw sized for placement about a pressurized hose, the jaw having a first end portion and a second end portion distal and generally opposite to the first end portion, a handgrip pivotally attached to the first end portion of the jaw, the handle having a normal position, and a plunger movably secured in the first end portion of the jaw. The plunger has a first end for contacting a portion of the handgrip and a second end opposite the first end of the plunger for grasping the surface of the pressurized hose. The plunger is responsive to the movement of the handgrip wherein the plunger moves in a first direction toward the second end portion of the jaw as the handgrip is pivoted in one direction and wherein the plunger moves in a second direction away from the second end portion of the jaw as the handgrip is moved back to the normal position.

18 Claims, 4 Drawing Sheets

APPARATUS FOR GRIPPING A FLUID CARRYING HOSE

This application claims the benefit of the filing date of commonly owned and copending U.S. Provisional Application Ser. No. 60/036,304 filed Apr. 11, 1997.

BACKGROUND OF THE INVENTION

COPYRIGHT NOTICE

©Copyright 1998, Ronald S. Hollister and Thomas S. Corbett. All rights reserved. A portion of the disclosure of this patent document contains material that is subject to copyright protection. The copyright owners have no objection to the facsimile reproduction by anyone of the patent document or the patent disclosure, as it appears in the USPTO patent file or records, but otherwise reserves all copyright rights whatsoever.

1. Field of the Invention

The present invention relates to an apparatus for gripping a fluid carrying hose.

2. Problem to be Solved

Fluid carrying hoses are used in many settings. For example, fluid carrying hoses are used in the fire fighting, chemical, petroleum and water treatment industries. There are many other settings in which fluid carrying hoses are utilized.

In many of the applications mentioned above, the fluid carrying hoses are generally of relatively large diameter and the fluid pressure therein is relatively high. For example, in the fire fighting industry, the fluid pressure in the hose is relatively high in order to move and/or eject a large volume of water a relatively long distance from the outlet of the hose to the fire. As a result, the reactive force on the hose is also relatively high thereby often necessitating more than one person handling the end of the hose. In a fire fighting scenario, handling the hose is made all the more difficult due to the conditions generally encountered, e.g. obstacles and debris, the need to advance the hose through and around unfamiliar structures, darkness or reduced visibility due to smoke, difficulty in gripping the hose due to excessive moisture on the hose, fatigue of the personnel handling the hose, etc.

Accordingly, it is an object of the present invention to provide an apparatus for gripping a pressurized fluid carrying hose that provides the personnel handling the hose with a significantly improved grip on the hose.

It is another object of the present invention to provide an apparatus for gripping a pressurized fluid carrying hose that can be quickly attached to a hose.

It is another object of the present invention to provide an apparatus for gripping a pressurized fluid carrying hose that does not significantly distort the hose or interfere with the flow of fluid through the hose.

It is another object of the present invention to provide an apparatus for gripping a pressurized fluid carrying hose that is easy to use.

It is another object of the present invention to provide an apparatus for gripping a pressurized fluid carrying hose that is portable.

It is a further object of the present invention to provide an apparatus for gripping a pressurized fluid carrying hose that can be inexpensively manufactured.

These and other objects of the present invention will become readily apparent upon further review of the following specification and drawings.

SUMMARY OF THE INVENTION

The present invention is directed to an apparatus for gripping a pressurized fluid carrying hose. The apparatus may be removably and adjustably installed quickly about the outer circumference of a pressurized fluid carrying hose to provide hose handling personnel with a better grip than is ordinarily attainable by merely grasping the outer surface of the hose with their hands.

The apparatus comprises a jaw sized for placement about a pressurized hose. The jaw has a first end portion and a second end portion distal that is generally opposite to the first end portion. The apparatus includes a handgrip pivotally attached to the first end portion of the jaw. The handle has a normal position. The apparatus further includes a plunger movably secured in the first end portion of the jaw. The plunger has a first end for contacting a portion of the handgrip and a second end opposite the first end of the plunger for grasping the surface of the pressurized hose. The plunger is responsive to the movement of the handgrip wherein the plunger moves in a first direction toward the second end portion of the jaw as the handgrip is pivoted in one direction and wherein the plunger moves in a second direction away from the second end portion of the jaw as the handgrip is moved back to the normal position.

The handgrip allows hose handling personnel to handle the pressurized hose without undue stress and strain, as often occurs when attempting to grip a wet hose with the hands.

When a user handling the hose wishes to remove the apparatus from the hose, either to transfer to another hose or to readjust the position of the apparatus on the hose, he/she need only relax his/her grip on the handgrip for it to extend to the normal position in order to remove the gripping pressure of the second end of the plunger from the pressurized hose.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

Similar reference characters denote corresponding features consistently throughout the attached drawings.

DETAILED DESCRIPTION OF THE INVENTION

Figure 1:
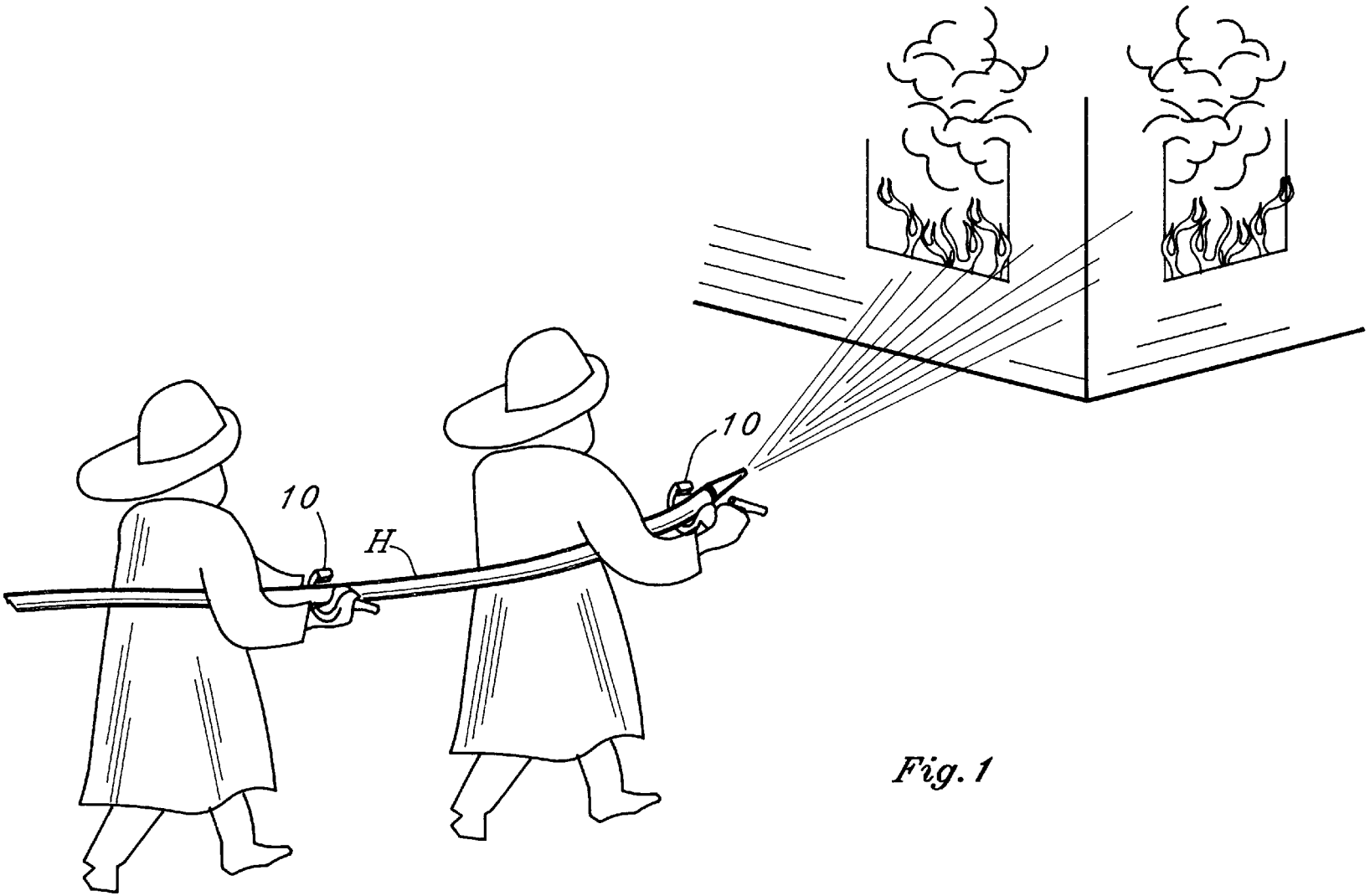
FIG. 1 is a perspective view illustrating the use of the apparatus of the present invention on a pressurized fire hose.
Figure 2:
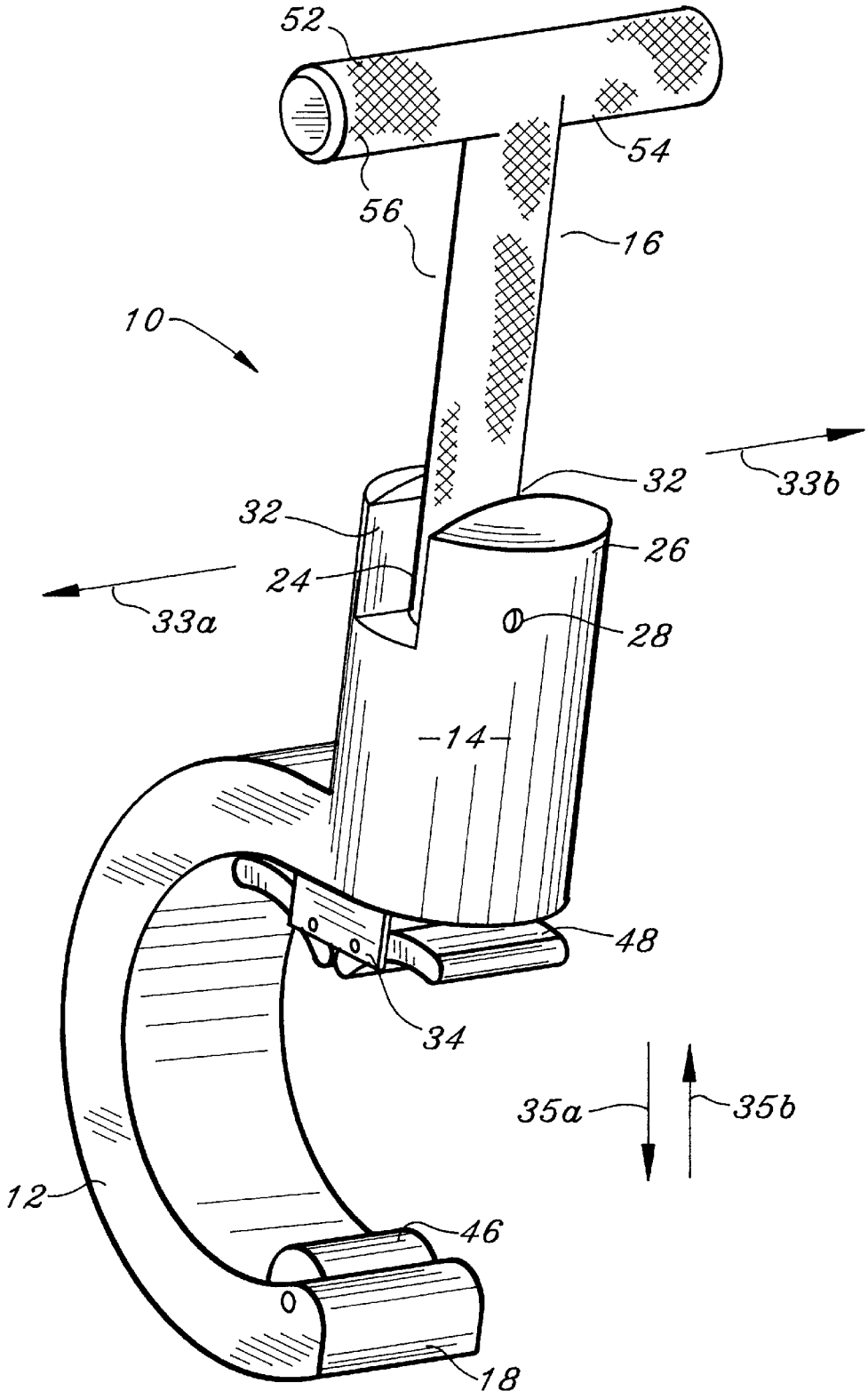
FIG. 2 is perspective view of a first embodiment of the apparatus of the present invention.
Figure 3:
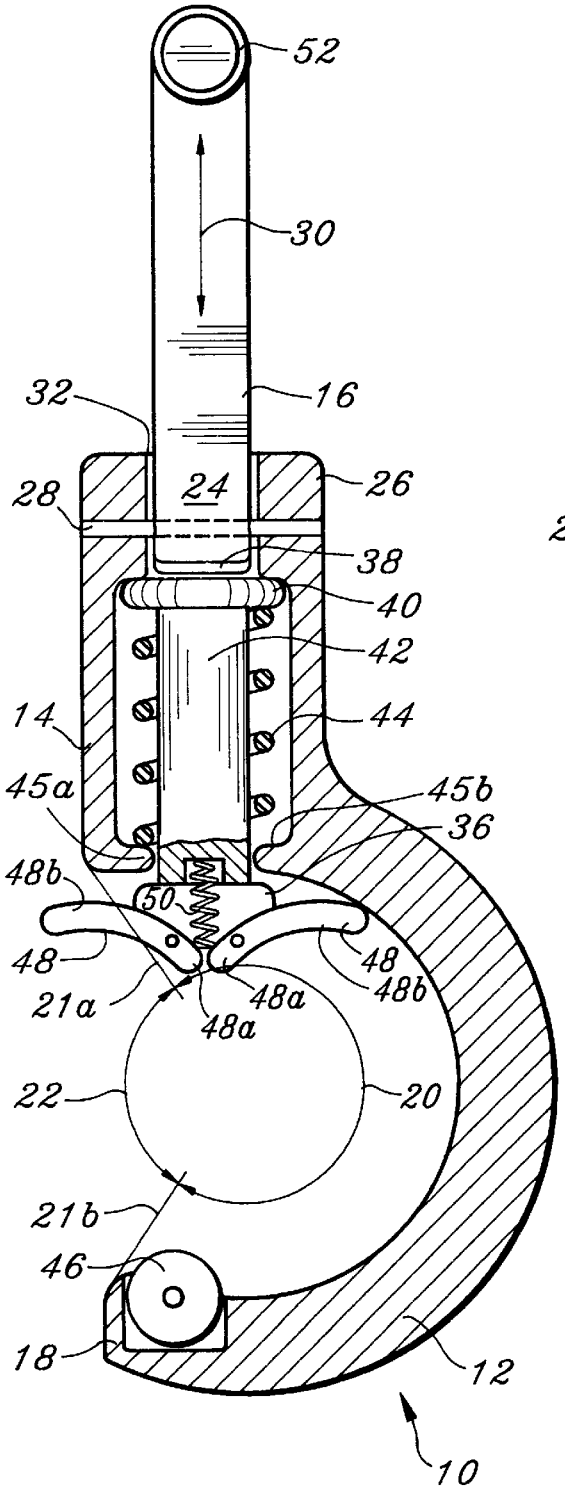
FIG. 3 is a sectional, side elevational view of the apparatus of FIG. 2.

FIG. 2 shows a perspective view of apparatus 10 of the present invention. Apparatus generally comprises a jaw 12 adapted to be removably placed about a pressurized hose H (see FIG. 1). In a preferred embodiment, jaw 12 is substantially semi-circular in shape or is substantially C-shaped. However, jaw 12 can be configured in other shapes as well. As used herein, "hose" refers to a hose having a substantial pressure head of fluid therein, causing the wall of the hose H to distend to a firm and circular cross-section. The jaw 12 includes a handgrip end 14 to which an elongate handgrip 16 is pivotally attached. The jaw 12 further includes an opposite distal end 18. Referring to FIG. 3, in one embodiment, apparatus 10 is configured such that the jaw 12 subtends an arc 20 of more than 180 degrees measured between reference lines 21*a* and 21*b* in a clockwise direction and starting at reference line 21*a*. In such an embodiment, the open side of jaw 12 has a substantially arcuate opening 22 of less than 180 degrees measured between reference lines 21*a* and 21*b* in a counter-clockwise direction and starting at reference line 21*a*. However, it is to be understood that the jaw 12 of apparatus 10 can be configured with other geometrical dimensions as well.

Referring to FIGS. 2 and 3, apparatus 10 further includes a handgrip end extension 26 that extends generally radially from the handgrip end 14 of the jaw 12. The handgrip 16 has an attachment end 24 that is pivotally secured to a handgrip end extension 26 of the jaw 12 by a pin 28. A slot or relief 32 extends through the extension 26 allowing the handgrip 16 to be folded or pivoted in the directions indicated by arrows 33*a* and 33*b* (see FIG. 2). Thus, the slot or relief 32 enables movement of handgrip 16 generally along the axis of the pressurized hose when such a hose is positioned within the jaw 12. To facilitate understanding of the present invention, the ensuing description will refer to the position of handgrip 16 as shown in FIGS. 2 and 3 as the "twelve o'clock" position. When the handgrip is in the "twelve o'clock" position, the handgrip 16 is positioned such that the axis 30 of the handgrip 16 being generally radial to the jaw 12.

Referring to FIG. 2, handgrip 16 is pivotal in the direction indicated by arrow 33*a* to a position in which the axis 30 of the handgrip 16 is generally perpendicular to the position of the axis 30 when the handgrip 16 is in the twelve o'clock position. Such a position is referred to herein as the "nine o'clock" position. Referring to FIG. 2, handgrip 16 is also pivotal in the direction indicated by arrow 33*b* to a position in which the axis 30 of the handgrip 16 is generally perpendicular to the position of the axis 30 when the handgrip 16 is in the twelve o'clock position. Such a position is referred to herein as the "three o'clock" position.

Figure 4:
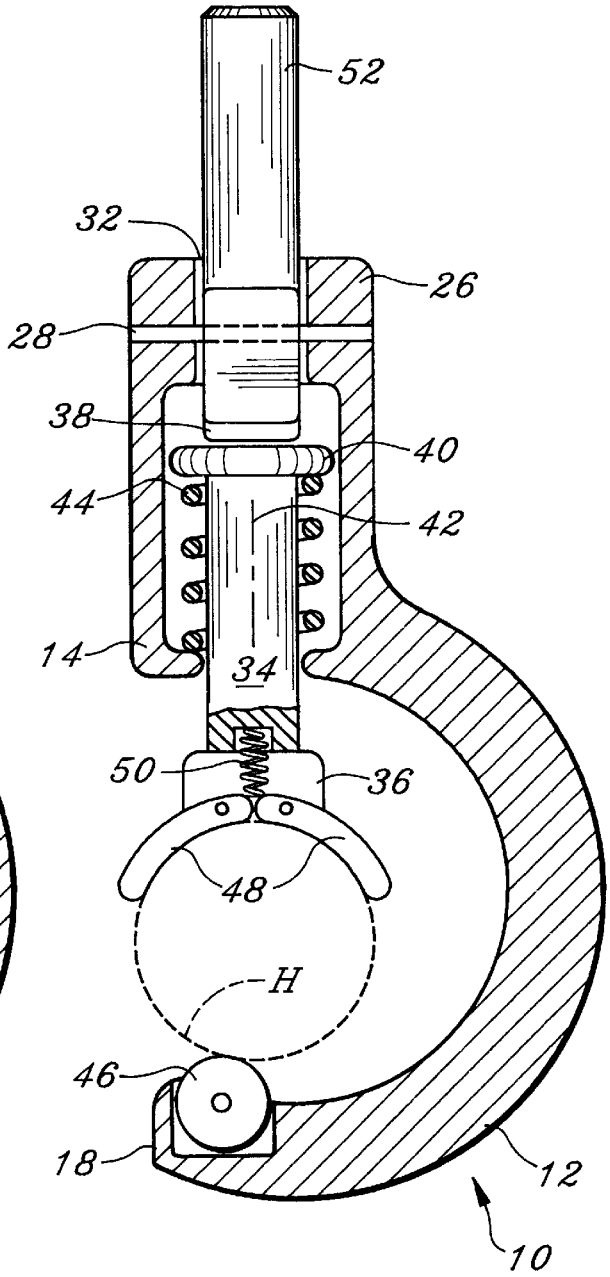
FIG. 4 is a sectional, side elevational view of the apparatus of the present invention showing the partial closing of a hose contact against an outer surface of the pressurized hose.

Referring to FIGS. 2 and 3, apparatus 10 further includes plunger 34. Plunger 34 has a hose contact end 36. In a preferred embodiment, plunger 34 has a substantially circular cross-section. However, plunger 34 can be configured to have other shapes as well. The plunger 34 has a contact end 40. In a preferred embodiment, contact end 40 is generally circular in shape and has a diameter that is greater than the diameter of plunger 34. In one embodiment, contact end 40 has a substantially flat surface. In another embodiment, contact end has a recess formed in the surface thereof for reasons that will be discussed below. The plunger 34 has an elongate axis 42 that is essentially parallel with the axis 30 of the handgrip 16 when the handgrip 16 is positioned as shown in FIG. 2, i.e. the twelve o'clock position or radially disposed to the jaw 12. The attachment end 24 of the handgrip 16 includes a cam lobe 38 extending therefrom. Referring to FIG. 4, when the handgrip 16 is pivoted in the direction indicated by arrow 33*a*, cam lobe 38 contacts or bears upon contact end 40 thereby causing plunger 34 to radially move along the axis 42 in a direction indicated by arrow 35*a* (see FIG. 2) so as to urge the hose contact end 36 of the plunger 34 against a pressurized hose H placed within the jaw 12. As the handgrip 16 is pivoted in the direction indicated by arrow 33*b*, cam lobe 38 is withdrawn from contact with the contact end 40 thereby causing plunger 34 to radially move along the axis 42 in a direction indicated by arrow 35*b* (see FIG. 2) so as to release the grip of contact end 36 of the plunger 34 on the pressurized hose H within the jaw 12. In one embodiment, cam lobe has a substantially rounded shape. In another embodiment, cam lobe 38 has a substantially square shape and contact end 40 is configured to have a recess for receiving cam lobe 38. In such an embodiment, the substantially square shape of the cam lobe 38 cooperates with the recess formed in contact end 40 to minimize any single point of contact, between the cam lobe 38 and the contact end 40 of the plunger, and to evenly distribute the force resulting from contact between cam lobe 38 and contact end 40.

In another embodiment, slot or relief 32 is formed in extension 26 such that handle 16 pivots in a manner such that the axis 30 of handle 16 is generally perpendicular to the axis of a pressurized hose secured within jaw 12. In such an alternate embodiment, the operation of apparatus 10 remains the same, the only difference being that the alternate orientation of the slot or relief 32 changes the plane of arcuate or pivotal movement of handgrip 16.

As shown in FIG. 3, in a preferred embodiment, apparatus 10 includes compression spring 44. Spring 44 is disposed about plunger 36 and is interposed between contact end 40 and stepped portions 45*a*, 45*b* of handgrip end 14. Spring 44 and cam lobe 38 cooperate to urge the handgrip 16 to a normal position when the handgrip 16 is not being manipulated by a user. In a preferred embodiment, such a normal position is the three o'clock position discussed above. However, it is to be understood that spring 44 and cam lobe 38 may be configured to urge handgrip 16 to any other orientation when the handgrip 16 is not being manipulated by a user. As a result of the handgrip 16 being in the normal position, plunger 34 is retracted to a position that is farthest from the distal end 18. Thus, when the handgrip 16 is in the normal position, the apparatus 10 can be easily installed over a pressurized hose H due to the relatively wide space between the hose contact end 36 of the plunger 34 and the distal end 18 of the jaw 12. Once the jaw 12 is placed about the exterior of the hose H, the handgrip 16 is folded or pivoted in the direction indicated by arrow 33*a* so cam lobe 38 bears upon the contact end 40 in order to radially move the plunger 34 in the direction indicated by arrow 35*a* (see FIG. 2) to grip the hose H between the hose contact end 36 and the opposite distal end 18 of the jaw 12. FIG. 4 shows apparatus 10 installed on hose H.

As shown in FIGS. 2–4, distal end 18 of jaw 12 is preferably rounded with a wide radius in order to minimize any sharp single point of contact with the hose and to spread the gripping force over a wider surface area of the pressurized hose. In one embodiment, roller 46 is included in the distal end 18 of the jaw 12 to minimize any sharp single point of contact with the hose, to spread the gripping force over a greater surface area of the pressurized hose and to prevent any abrasion to the surface of the hose. Thus, such a configuration prevents the wall of the hose from being damaged or weakened and also prevents interference with the flow of fluid through the hose.

Referring to FIGS. 3–4, in a preferred embodiment, the plunger hose contact end 36 is configured for distributing and spreading the pressure applied by the hose contact end 36 to the hose. In such configuration, a pair of wide, spring loaded gripping flanges 48 are pivotally attached to hose contact end 36 of plunger 34. Flanges 48 extend to each side of the hose contact end 36 of the plunger 34. The flanges 48 are urged away from the hose contact end 34 by a flange spring 50, thereby urging ends 48*a* of flanges 48 toward the pressurized hose H placed within the jaw 12, but moving their opposite distal ends 48*b* away from the hose H, as shown in FIG. 3. Thus, when a hose H is grasped within the jaw 12 and the handgrip 16 is pivoted downwardly to capture the hose H between the hose contact end 36 of the plunger 34 and the distal end 18 of the jaw 12, the firmness of the pressurized hose H pushes the ends 48*a* of the flanges 48 away from the hose H thereby causing the distal ends 48*b* to wrap more securely about the hose H and to spread the gripping pressure about the surface area of the hose.

In a preferred embodiment, handgrip 16 is substantially T-shaped. For example, as shown in FIGS. 2–4, handgrip 16 includes a transverse cross-member extension 52 attached to the distal end 54 of the handgrip 16. The cross-member 52 is oriented with its length substantially parallel to the elongate axis of a pressurized hose H placed within the jaw 12. Thus, a user of apparatus 10 need only grasp the transverse cross-member 52 and pivot it as indicated by the arrow 33*a* in FIG. 2 in order to cause apparatus 10 to grip the hose as described above. In an alternate embodiment, the handgrip 16 is configured without cross-member 52. In a preferred embodiment, handgrip 16, and cross-member 52, have outer surfaces 56 configured to provide a relatively high coefficient of friction. In one embodiment, this is accomplished by knurling. However, other suitable configurations can also be used, e.g. rubberized coating, etc.

Referring to FIGS. 2–4, when the users of apparatus 10 desire to place the jaw 12 about a pressurized hose, the users release the handgrip 16 so that the handgrip 16 moves to the normal position, i.e. the three o'clock position. As a result, the plunger 34 is retracted to the farthest extent and provides a relatively wide space within the jaw 12 to receive pressurized hoses of relatively large diameters. For smaller diameter hose, the users must pivot the handgrip 16 in the direction indicated by arrow 33*a* to move the plunger 34 toward distal end 18 of the jaw 12. The apparatus 10 can be configured for use with many of the standard size hoses that are used today in industry or by firefighters. As an example, apparatus 10 can be configured in a manner such that a user: (i) positions the handgrip 16 to the normal or three o'clock position to in order to place the jaw 12 about a pressurized hose having a diameter of about 3 (three) inches, (ii) positions the handgrip 16 to the twelve o'clock position in order to place the jaw 12 about a pressurized hose having a diameter of about 2½ inches, and (iii) positions the handgrip 16 to the nine o'clock position to in order to place the jaw 12 about a pressurized hose having a diameter of about 1¾ inches.

Figure 5:
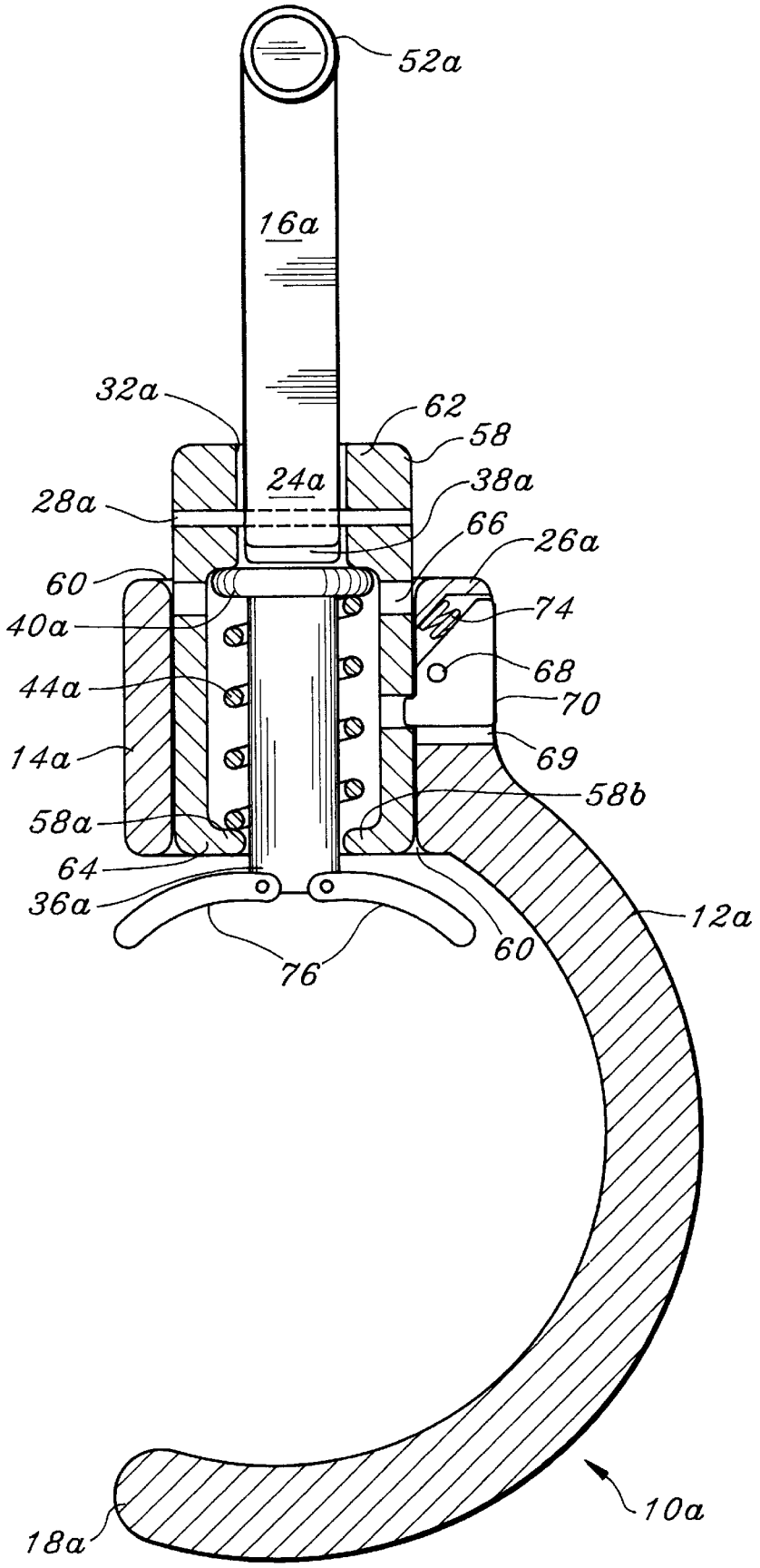
FIG. 5 is a sectional, side elevational view of an alternate embodiment of the apparatus of the present invention.

Referring FIG. 5, there is shown an alternate apparatus 10*a* of the present invention. The basic structure of apparatus 10*a* is similar to apparatus 10 shown in FIGS. 2–4. However, apparatus 10*a* further includes additional components to provide adjustment for different hose diameters. Handgrip end 14*a* of jaw 12*a* has a passage 60 radially disposed therethrough. Hose diameter adjustment body 58 is telescopingly or slidably disposed within the passage 60. The adjustment body 58 includes a handgrip 16*a* pivotally secured to the portion 62 by a pin 28*a* disposed through the handgrip attachment end 24*a* of handgrip 16. The handgrip attachment end 24*a* has a cam lobe 38*a* formed thereon. Cam lobe 38*a* communicates with the handgrip contact end 40*a* of the hose contact plunger 34*a* in a manner similar to that described for apparatus 10. The handgrip 16*a* is pivoted or folded arcuately in one direction into the relief 32*a* to extend the plunger 34*a* from the adjustment body inner end 64 toward the opposite jaw distal end 18*a* of the jaw 12*a* in order to grip a pressurized hose between the plunger hose contact end 36*a* and the distal end 18*a*. A spring 44*a* is disposed about the plunger 34*a* within the adjustment body 58 and is interposed between contact end 40*a* and stepped portions 58*a*, 58*b* of adjustment body 58. Spring 44a urges the plunger 34*a* inwardly away from the jaw distal end 18*a* thereby requiring the handgrip 16*a* to be held constantly in its arcuately or folded position in order to grip a pressurized hose within the jaw 12*a*. This configuration also provides for immediate release of a hose gripped within jaw 12*a* to effect quick removal of the hose from the jaw 12*a* or to effect quick repositioning of the apparatus 10*a* along the hose when the handgrip 16*a* is released, in a manner similar to that described for apparatus 10 in FIGS. 2–4.

As shown in FIG. 5, adjustment body 58 is telescopingly or slidably disposed within the handgrip end extension 26*a* of the apparatus 10*a*, allowing the entire assembly contained within the adjustment body 58 to be repositioned relative to the distal end 18*a* of the jaw 12*a*. The adjustment body 58 includes a plurality (two or more) of notches 66 formed within the side of the adjustment body 58. In one embodiment, the adjustment body 58 is keyed or otherwise held in registry with the extension end 26*a* and a similar configuration is used to hold the plunger 34*a* in registry with the adjustment body 58 in order to preclude the plunger 34a from turning relative to the adjustment body 58 and to preclude the adjustment body 58 from turning relative to extension end 26*a*.

Referring to FIG. 5, adjustment body 58 further includes a latch 68 that is secured within a recess or cavity 69 formed in the side of the extension end 26*a*. The latch 68 is secured by and pivots about a pin 70. The latch 68 further includes a protruding portion or protruding tang 72 that selectively engages one of the notches 66 of the adjustment body 58. A compressive latch spring 74 is interposed between the wall of the recess and the latch 68. The tang 72 of the latch 68 is normally biased or urged toward a locking position by the latch spring 74 in order to hold the adjustment body at the selected position in the handgrip extension 26*a*.

The above described assembly, shown in FIG. 5, allows a user to adjust apparatus 10*a* to fit a given diameter of a pressurized hose merely by adjusting the position of adjustment body 58 within extension end 26*a*. If it is desired to go from a relatively larger diameter of hose (as with the setting shown in FIG. 5) to a smaller diameter hose, the user depresses the portion of the latch 68 that is adjacent to the spring 74 in order to pivot the latch 68 about the pin 70 and withdraw the tang 72 from the lowermost or innermost notch 66 within the adjustment body 58. The adjustment body 58 is then telescoped or moved inwardly (toward distal end 18*a*) and the latch 68 is released while with the latch spring 74 automatically urges the tang 72 into the next notch 66 to lock the assembly at the new position. Apparatus 10*a* further includes curved gripping flanges 76 that extend from the hose contact end 36*a* of the hose contact plunger 34*a*. In one embodiment, flanges 76 are rigidly attached to end 36*a*. In another embodiment, flanges 76 are pivotally attached to end 36*a*.

Referring to FIG. 5, cross-member 52*a* may be configured as the cross-member 52 of apparatus 10 which is shown in FIGS. 2–4. Furthermore, apparatus 10*a* may be configured to include the roller 46 and the automatically adjusting gripping flanges 48 as shown in FIGS. 2–4.

Apparatuses 10 and 10*a* of the present invention enable hose-handling personnel to efficiently and safely handle a highly pressurized or charged hose. As an example, the present invention enables fire-fighting personnel to efficiently and safely handle a highly pressurized fire hose under the extreme and dangerous conditions often present when battling fires. The configuration of apparatuses 10 and 10*a* enable fire-fighting personnel to quickly secure apparatus 10 or 10*a* to a pressurized hose from either the left or right, as shown in FIG. 1. The folded handgrip 16 or 16*a* provides the fire-fighters with a firm and steady grip when apparatus 10 or 10*a* is secured to the fire hose. Apparatus 10 or 10*a* may be quickly and easily removed from the hose or moved along the hose simply by relaxing the grip on the handgrip 16 or 16*a* to allow the jaw 12 or 12*a* to retract as the handgrip extends in order to loosen the grip on the hose within the jaw 12 or 12*a*.

Thus, the apparatuses 10 and 10*a* of the present invention:

a) facilitate handling of highly pressurized fluid carrying hoses;

b) can be used on hoses of varying diameters;

c) are easy to use;

d) are portable and can be conveniently stored when not in use;

e) do not interfere with the flow of fluid through the hose when the: apparatuses 10 and 10*a* are secured to the hose;

f) do not damage or distort the hose when the apparatuses 10 and 10*a* are secured to the hose; and g) are relatively inexpensive to manufacture and maintain.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for gripping a fluid carrying hose, comprising:

a jaw sized for placement about a pressurized hose, the jaw having a first end portion and a second end portion distal and generally opposite to the first end portion, the first end portion defining a bore;

a handgrip pivotally attached to the first end portion of the jaw, the handle being pivotal between a first position and a second position; and a plunger movably disposed within the bore of the first end portion of the jaw, the movement of the plunger being substantially rectilinear, the plunger having a first end for contacting a portion of the handgrip and a second end opposite the first end of the plunger for grasping the surface of the pressurized hose, the plunger being responsive to the movement of the handgrip wherein the plunger moves in a first direction toward the second end portion of the jaw as the handgrip is pivoted toward the second position and wherein the plunger moves in a second direction away from the second end portion of the jaw as the handgrip pivots back to the first position.

2. The apparatus according to claim 1 wherein the jaw is substantially C-shaped.

3. The apparatus according to claim 1 wherein the handgrip includes has a cam lobe that bears upon the first end of the plunger as the handgrip is pivoted toward the second position.

4. The apparatus according to claim 1 wherein the handgrip has an axis and wherein when a pressurized hose is within the jaw and the handgrip is in the first position, the axis of the handgrip is generally parallel to the axis of the hose.

5. The apparatus according to claim 3 further including means for urging the handgrip in the first position.

6. The apparatus according to claim 1 wherein the plunger has a substantially circular cross-section.

7. The apparatus according to claim 6 wherein the first end of the plunger is substantially flat and substantially circular in shape.

8. The apparatus according to claim 1 wherein the second end of the plunger comprises a hose contact, the hose contact having a contour configured for grasping the surface of the pressurized hose.

9. The apparatus according to claim 8 wherein the hose contact comprises a pair of gripping flanges attached to the second end of the plunger.

10. The apparatus according to claim 7 wherein the gripping flanges are pivotally attached to the second end of the plunger.

11. The apparatus according to claim 10 further including means for urging the flanges into a predetermined orientation.

12. The apparatus according to 1 further including a spring about the plunger to urge the plunger in the second direction so as to cause the handgrip to move to the first position.

13. The apparatus according to claim 1 wherein the jaw further includes a roller secured in the second end portion so as to minimize point pressure on a pressurized fire hose.

14. The apparatus according to claim 1 wherein the handgrip includes a distal end opposite the portion of the handgrip that contacts the plunger, the handgrip further including a member transverse to the handgrip and attached to the distal end of the handgrip.

15. The apparatus according to claim 14 wherein the surfaces of the handgrip and the member that is transverse to the handgrip are configured to have a relatively high coefficient of friction.

16. The apparatus according to claim 1 wherein the first portion of the jaw includes a passage therethrough that extends radially to the jaw, the apparatus further including an adjustment body slidably disposed within the passage, the adjustment body having a first end portion and a second end portion, the handgrip having one end portion pivotally attached to first end portion of the adjustment body, the adjustment body having a passage therethrough that extends radially to the jaw, the second end portion of the adjustment body having portions stepped inward into the passage of the adjustment body, the plunger being movably disposed within the passage of the adjustment body, the apparatus further comprising:

a spring disposed about the plunger and intermediate the first end of the plunger and the portions that are stepped inward into the adjustment body for urging the plunger in a direction away from second end portion of the jaw;

a plurality of longitudinally spaced notches formed in the adjustment body, each notch representing a predetermined distance to which the adjustment body can be positioned with respect to the second end portion of the jaw; and a latch movably attached to the first end portion of the jaw, the latch having a protruding portion sized for insertion into any of the notches of the adjustment body.

17. The apparatus according to claim 16 wherein the first end portion of the jaw further includes a recess sized for receiving the latch, the latch being pivotally attached to the first end portion of the jaw, the apparatus further including a spring disposed within the recess and interposed between the latch and the wall of the recess to urge the protruding portion of the latch against the adjustment body.

18. The apparatus according to claim 17 wherein the second end of the plunger comprises a pair of gripping flanges.

* * * * *